US011090800B2

(12) United States Patent
Zhang

(10) Patent No.: US 11,090,800 B2
(45) Date of Patent: Aug. 17, 2021

(54) TOOL BOX

(71) Applicant: Nanjing Chervon Industry Co., Ltd., Nanjing (CN)

(72) Inventor: Xiaofeng Zhang, Nanjing (CN)

(73) Assignee: Nanjing Chervon Industry Co., Ltd., Nanjing (CN)

( * ) Notice: Subject to any disclaimer, the term of this patent is extended or adjusted under 35 U.S.C. 154(b) by 0 days.

(21) Appl. No.: 17/200,325

(22) Filed: Mar. 12, 2021

(65) Prior Publication Data

US 2021/0197360 A1 Jul. 1, 2021

Related U.S. Application Data

(63) Continuation of application No. PCT/CN2019/108168, filed on Sep. 26, 2019.

(30) Foreign Application Priority Data

Sep. 26, 2019 (CN) ..... 201821599790.X

(51) Int. Cl.
*B65D 73/00* (2006.01)
*B25H 3/02* (2006.01)

(52) U.S. Cl.
CPC ..... *B25H 3/02* (2013.01)

(58) Field of Classification Search
CPC ..... B25H 3/02; B25H 3/006
USPC ..... 206/349, 372, 373; 211/70.6
See application file for complete search history.

(56) References Cited

U.S. PATENT DOCUMENTS 3,261,454 A * 7/1966 Elson ..... B25H 3/02 206/349
3,719,271 A * 3/1973 Authier et al. ..... B65D 85/58 206/711
4,415,080 A * 11/1983 Romine ..... B65D 85/62 206/303

(Continued)

FOREIGN PATENT DOCUMENTS

CN 101301752 A 11/2008
CN 204056601 U 12/2014

(Continued)

OTHER PUBLICATIONS

ISA/CN, International Search Report issued on PCT application No. PCT/CN2019/108168, dated Dec. 30, 2019, 3 pages.

*Primary Examiner* — Luan K Bui
(74) *Attorney, Agent, or Firm* — Greenberg Traurig, LLP

(57) ABSTRACT

A tool box includes a box body and a tool-head fixing assembly. The tool-head fixing assembly is configured to fix the tool head. The tool-head fixing assembly includes a first positioning column and an elastic member. The first positioning column includes a positioning part and a mounting part. The positioning part extends in a first straight line, and the tool head is sleeved on the positioning part. The mounting part is connected to the box body. The tool-head fixing assembly has an assembled state and a disassembled state, when the tool-head fixing assembly is in the assembled state, the elastic member is mounted above the tool head, the elastic member forms an interference fit with the positioning part, and a projection of the elastic member on a plane perpendicular to the first straight line at least partially coincides with a projection of the tool head on the plane.

8 Claims, 6 Drawing Sheets

(56) References Cited

U.S. PATENT DOCUMENTS

| | | | | | |
|---|---|---|---|---|---|
| 4,811,843 | A * | 3/1989 | Stribiak | B23Q 13/00 | 134/201 |
| 4,896,771 | A * | 1/1990 | Edwards | A45C 5/00 | 206/349 |
| 5,078,266 | A * | 1/1992 | Rackley | B23D 59/00 | 206/303 |
| 6,669,111 | B2 * | 12/2003 | Vinson | A62C 31/28 | 239/288 |
| 2002/0029986 | A1 | 3/2002 | Shiga | | |

FOREIGN PATENT DOCUMENTS

| | | | |
|---|---|---|---|
| CN | 206032089 | U | 3/2017 |
| CN | 209022036 | U | 6/2019 |
| JP | H07290375 | A | 11/1995 |
| JP | 2006167883 | A | 6/2006 |

* cited by examiner

TOOL BOX

The present application is a continuation of International Application Number PCT/CN2019/108168, filed on Sep. 26, 2019, through which this application also claims the benefit of Chinese Patent Application No. 201821599790.X, filed Sep. 29, 2018, which applications are incorporated herein by reference in their entirety.

BACKGROUND

A tool box is mainly configured to accommodate various tools, such as saw blades with various shapes and sizes. The saw blade is typically fixed in the tool box by a fixing mechanism during storage. However, in the related art, the fixing mechanism typically includes a stud bolt disposed in the tool box and a nut used in combination with the stud bolt. When the saw blade is fixed, the stud bolt passes through a mounting hole arranged on the saw blade, and the nut is screwed to be sleeved on the stud bolt to abut against the saw blade, thus achieving the fixing of the saw blade. However, the stud bolt and the nut are easy to loosen in a long-term using process, so the saw blade moves up and down along an axis of the stud bolt when the tool box is moved, and thus the saw blade is easily damaged. In addition, it takes a long time to fix and release the saw blade by using the nut and the stud bolt, so rapid fixing and releasing of the saw blade is unable to be achieved.

SUMMARY

The present application provides a tool box capable of accommodating a tool head. The tool box fixes the tool head with a high stability, so that the tool head is not easy to move up and down, thereby achieving fast fixing and releasing of the tool head.

An example provides a tool box. The tool box includes a box body and a tool-head fixing assembly. The box body forms an accommodation space for accommodating a tool head. The tool-head fixing assembly is configured to fix the tool head. The tool-head fixing assembly includes a first positioning column and an elastic member. The first positioning column includes a positioning part and a mounting part. The positioning part extends in a direction where a first straight line extends, and the tool head is sleeved on the positioning part. The mounting part is connected to the box body. The tool-head fixing assembly has an assembled state and a disassembled state, when the tool-head fixing assembly is in the assembled state, the elastic member is mounted above the tool head, the elastic member forms an interference fit with the positioning part, and a projection of the elastic member on a plane perpendicular to the first straight line at least partially coincides with a projection of the tool head on the plane perpendicular to the first straight line.

DETAILED DESCRIPTION

Figure 1:
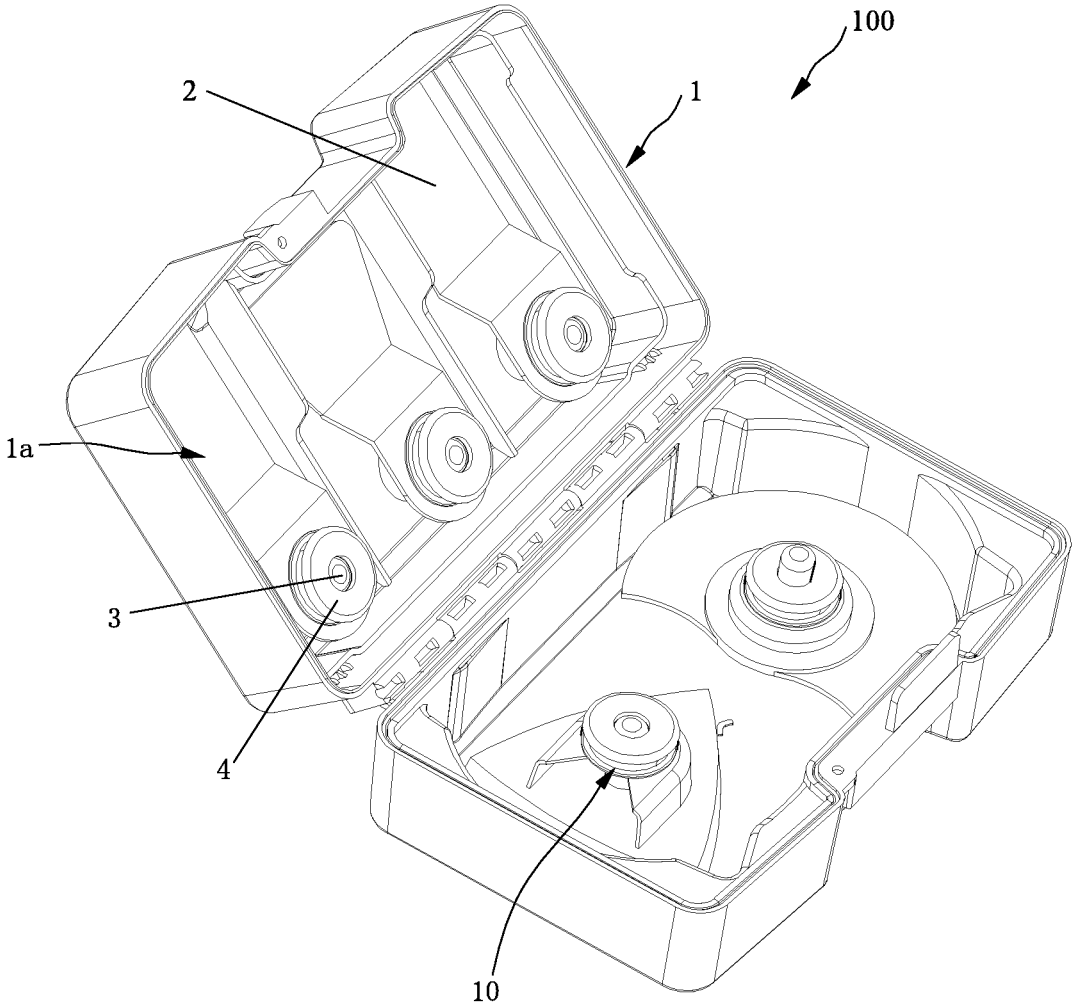
FIG. 1 is a structure view of a tool box according to an example.
Figure 2:
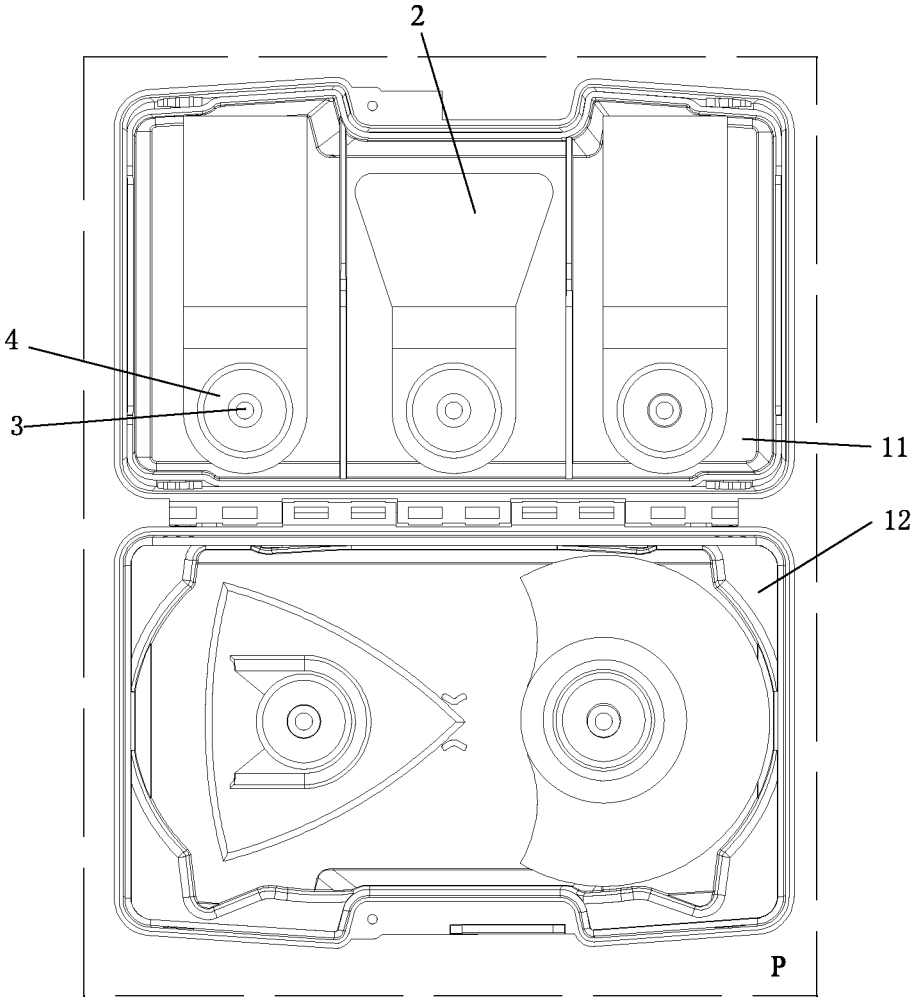
FIG. 2 is a top view of a tool box according to an example.
Figure 3:
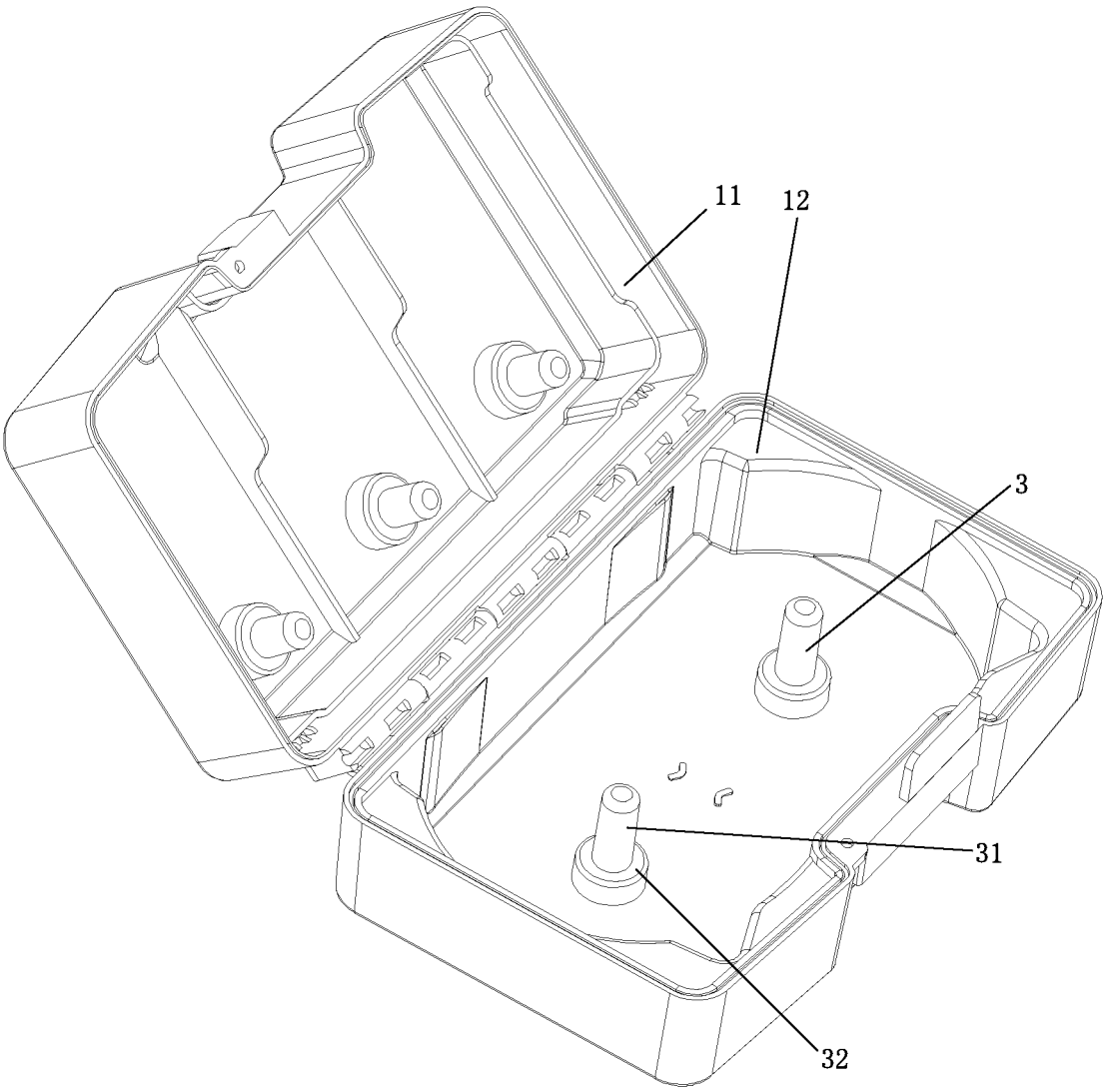
FIG. 3 is a structure view of a box body and a first positioning column of a tool box according to an example.

This example provides a tool box capable of accommodating a plurality of tool heads, and a position of the tool head in the tool box can be kept fixed, and the tool heads are saw blades as shown in FIG. 1. In this way, mutual collision between the tool head and a box wall of the tool box 100 and collision among the plurality of tool heads can be avoided when the tool box 100 is moved, thereby reducing a damage rate of the tool heads. In this example, a tool box 100 accommodating a plurality of the saw blades 2 is described as an example. As shown in FIG. 1 to FIG. 3, the tool box 100 includes a box body 1 and a tool-head fixing assembly 10 disposed in the box body 1. The box body 100 is provided with an accommodation space 1*a* for accommodating the tool heads. The box body 1 includes a first box body 11 and a second box body 12 that can be unfolded and closed, and a first end of the first box body 11 is rotatably connected to a first end of the second box body 12. A mode of rotatable connection is not limited herein, and for example, the rotatable connection may be implemented by using a structure such as a rotating shaft or a hinge. A second end of the first box body 11 and a second end of the second box body 12 can be detachably connected to each other, and a mode of detachable connection may be implemented by using a lock or a buckle. Shapes of the first box body 11 and the second box body 12 may be rectangular or may be made in other shapes according to the shape of the saw blade 2. The first box body 11 and the second box body 12 may be made of plastic, alloy or other materials. In order to reduce the cost and weight of the tool box 100, the box body is typically made of rigid plastic.

When a plurality of saw blades 2 with different shapes need to be accommodated in a tool box 100, dividing members may further be provided in the first box body 11 and the second box body 12. The dividing member may be configured to be a plate-like structure. The first box body 11 and the second box body 12 are divided into a plurality of small spaces by the dividing members, and one saw blade 2 is fixed in each small space, thereby avoiding collision between adjacent saw blades 2, and facilitating the user to quickly identify and select the required saw blade 2. In one example, the tool box 100 may further be provided with an anti-shock member. The anti-shock member may be shock-proof foam or the like, and the anti-shock member may be laid on a bottom surface and side walls of the tool box 100.

Figure 4:
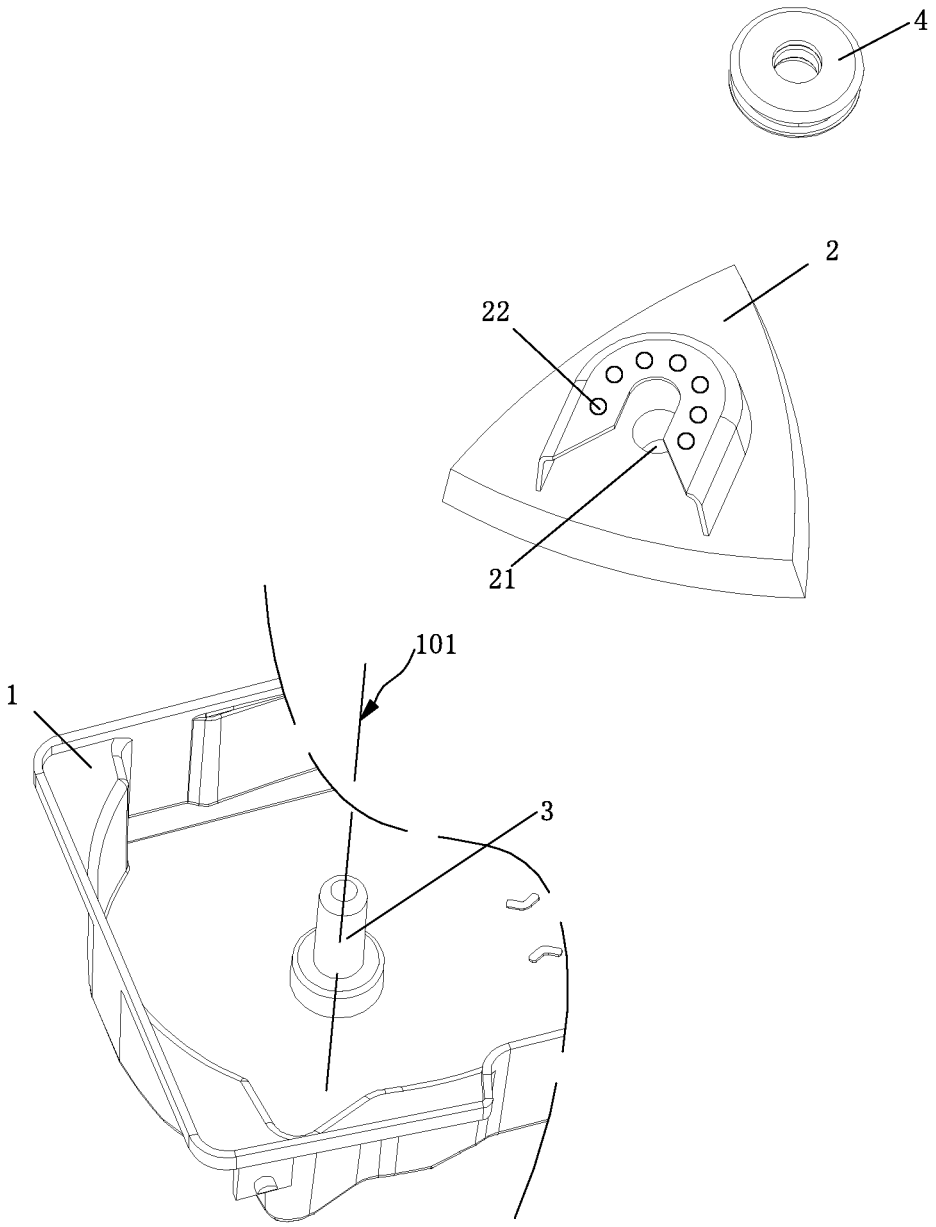
FIG. 4 is an exploded view of a partial structure of a tool box in a disassembled state according to an example.
Figure 5:
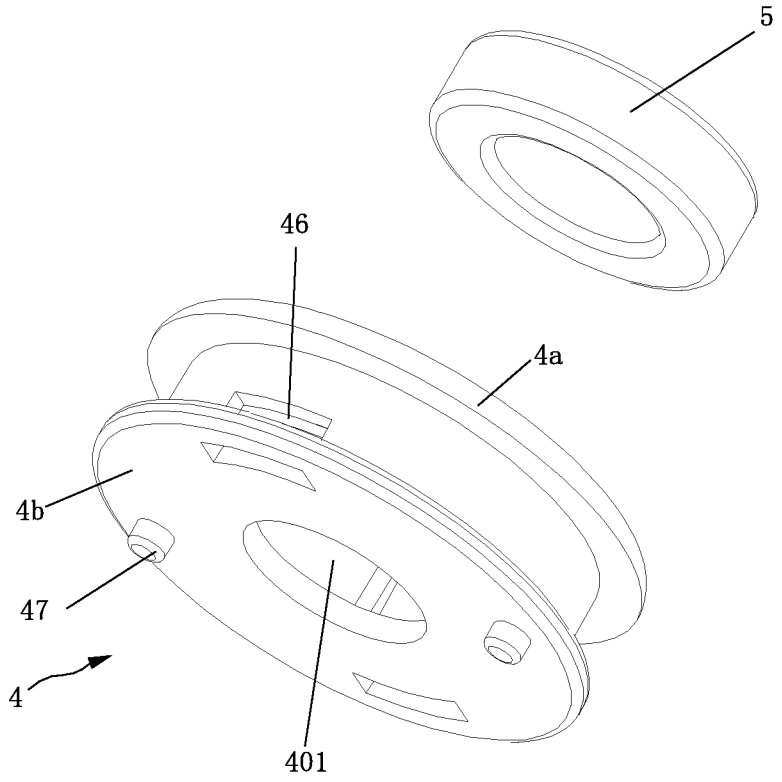
FIG. 5 is an exploded view of an elastic member and a pressing cover of a tool box according to an example.
Figure 6:
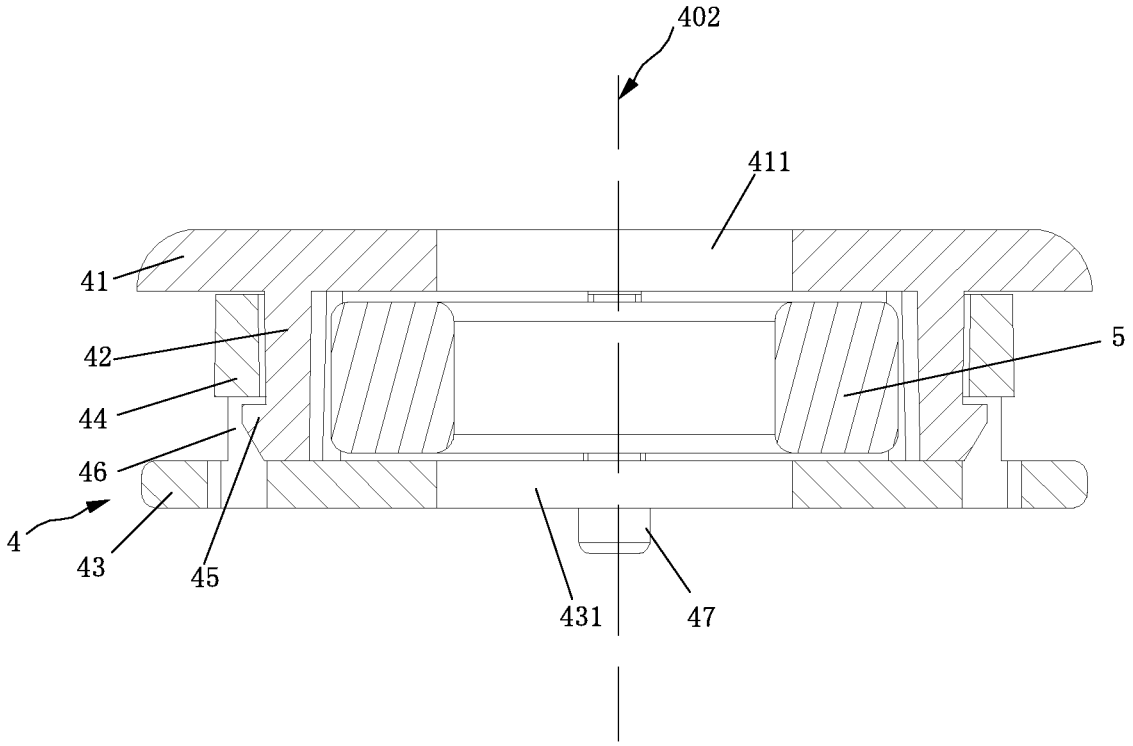
FIG. 6 is a sectional view of an elastic member and a pressing cover of a box tool in an assembled state according to an example.

The tool-head fixing assembly 10 is disposed in the first box body 11 and the second box body 12 and configured to fix a position of the saw blade 2 in the box body 1. As shown in FIG. 4 to FIG. 6, the tool-head fixing assembly 10 includes a first positioning column 3 and an elastic member 5 used in combination with the first positioning column 3. As shown in FIG. 3 and FIG. 4, the first positioning columns 3 are disposed on bottom surfaces of the first box body 11 and the second box body 12, and an axial direction of the first positioning column 3 is perpendicular to the bottom surfaces of the first box body 11 and the second box body 12. A first end of the first positioning column 3 is a mounting part 32, and a second end of the first positioning column 3 is a positioning part 31. The positioning part 31 extends in a first straight line 101, and the positioning part 31 is configured to mount the saw blade 2 and limit the motion of the saw blade 2 in a plane perpendicular to the first straight line 101. The motion here refers to the movement in the plane. If a cross-sectional shape of the positioning part 31 is quadrate or in other angular shapes, the rotation of the saw blade 2 in the plane perpendicular to the first straight line 101 can also be limited. The mounting part 32 is configured to mount the first positioning column 3 to the bottom surface of the first box body 11 or the bottom surface of the second box body 12. The saw blade 2 abuts against the bottom surface of the first box body 11 or the bottom surface of the second box body 12 after passing though the positioning part 31 from one end of the positioning part 31 facing from the mounting part 32. The positioning part 31 needs to have the same cross-sectional shape as a first mounting hole 21 of the saw blade 2, and a size of the cross section of the positioning part 31 is slightly smaller than a size of the cross section of the first mounting hole 21, such that the first positioning column 3 can smoothly pass through the first mounting hole 21. In this example, the positioning part 31 and the mounting part 32 are provided in a step shape, and the cross-sectional area of the mounting part 32 is larger than the cross-sectional area of the positioning part 31, so that the bottom surface of the saw blade 2 is supported by the mounting part 32, and the saw blade 2 can be taken from the tool box 100 by the user conveniently. The shape of the mounting part 32 is not limited so long as the first positioning column 3 cannot pass through the first mounting hole 21 completely. Since the shape of the first mounting hole 21 of the saw blade 2 is typically circular, in this example, both the mounting part 32 and the positioning part 31 of the first positioning column 3 are cylindrical.

The tool-head fixing assembly 10 has an assembled state and a disassembled state. When the tool-head fixing assembly 10 is in the assembled state, the elastic member 5 is mounted above the saw blade 2, the elastic member 5 forms an interference fit with the positioning part 31, and a projection of the elastic member 5 on a plane P perpendicular to the first straight line 101 at least partially coincides with a projection of the saw blade 2 on the plane P perpendicular to the first straight line 101. The elastic member 5 is mounted above the saw blade 2 and abuts against a top surface of the saw blade 2, such that the saw blade 2 is clamped between the elastic member 5 and one of the bottom surface of the first box body 11, the bottom surface of the second box body 12 or the mounting part 32, thereby limiting the movement of the saw blade 2 in the direction where the first straight line 101 extends. In one example, the elastic member 5 is an annular structure made of an elastic material, such as a rubber ring made of rubber. An inner ring of the elastic member 5 has the same circular shape as the cross-sectional shape of the first positioning column 3, and an inner ring diameter of the elastic member 5 is smaller than a diameter of the first positioning column 3. The shape of an outer ring of the elastic member 5 is not limited and may be a circular ring or a ring in other shapes, such as a ring having a quadrate cross-sectional shape. In this example, in order to reduce the manufacturing difficulty of the elastic member 5, the elastic member 5 is provided in a ring structure.

A using method of the tool-head fixing assembly 10 is described below. The saw blade 2 is disposed above the first positioning column 3, and the first mounting hole 21 of the saw blade 2 is opposite to the first positioning column 3. The positioning part 31 of the first positioning column 3 passes through the saw blade 2 and the saw blade 2 moves downward along the first positioning column 3 until the bottom surface of the saw blade 2 abuts against the mounting part 32, and at this time, the movement of the saw blade 2 in a horizontal direction can be limited. The positioning part 31 of the first positioning column 3 passes through the elastic member 5 and the elastic member 5 moves downward along the first positioning column 3 until the elastic member 5 abuts against the top surface of the saw blade 2, such that the saw blade 2 is stably clamped between the mounting part 32 of the first positioning column 3 and the elastic member 5, and at this time, the movement of the saw blade 2 in a vertical direction is also limited.

In this example, since the elastic member 5 has elasticity and a diameter of the inner ring of the elastic member 5 is smaller than a diameter of the first positioning column 3, the interference fit can be achieved when the elastic member 5 is sleeved on the first positioning column 3. Therefore, the friction force between the first positioning column 3 and the elastic member 5 is increased, thereby ensuring that the elastic member 5 does not move up and down on the first positioning column 3 when the tool box 100 is moved. In this way, the saw blade 2 is prevented from moving in the vertical direction, the fixing stability of the saw blade 2 is improved, and the damage rate of the saw blade 2 is reduced. In addition, when the saw blade 2 is fixed, the elastic member 5 is inserted into the first positioning column 3 and moves toward the saw blade 2 until the elastic member 5 abuts against the saw blade 2, and the saw blade 2 can be released through the reverse operation. The whole process takes little time, which is beneficial to improve the fixing and releasing efficiency of the saw blade 2.

In order to further increase the abutting pressure of the elastic member 5 against the saw blade 2, the tool-head fixing assembly 10 further includes a pressing cover 4. As shown in FIG. 5, the pressing cover 4 is a structure made of a rigid material, the pressing cover 4 is provided with a through hole 401, and at least a part of the elastic member 5 is located in the through hole 401. When the tool-head fixing assembly 10 is in the assembled state, both the pressing cover 4 and the elastic member 5 are sleeved on the first positioning column 3, and a bottom surface of the pressing cover 4 can abut against the top surface of the saw blade 2. Since the pressing cover 4 is made of the rigid material and is not easily deformed, and the pressing cover 4 abuts against the top surface of the saw blade 2, so that the effect that the saw blade 2 is fixed can be further improved.

In one example, in order to facilitate installing the elastic member 5 in the pressing cover 4, as shown in FIG. 6, the pressing cover 4 includes a first cover body **4*a* and a second cover body 4*b* which are detachably connected to each other. The first cover body 4*a* includes a first plate 41 and a first accommodating ring 42 extending from a bottom surface of the first plate 41 and perpendicular to the bottom surface of the first plate 41. The first accommodating ring 42 is a circular ring. The first plate 41 located in the interior of the first accommodating ring 42 is provided with a first through hole 411. The first through hole 411 is a circular hole and communicates with an inner space of the first accommodating ring 42, and a diameter of the first through hole 411 is smaller than a diameter of an inner ring of the first accommodating ring 42. The elastic member 5 is disposed in the first accommodating ring 42, and the inner ring of the elastic member 5 is disposed coaxially with the first through hole 411. The second cover body 4*b* includes a second plate 43, the second plate 43 is configured to cover an opening end of the first accommodating ring 42, and a position of the second plate 43 facing the first through hole 411 is provided with a second through hole 431. A diameter of the second through hole 431 and a diameter of the first through hole 411 may be the same or different, as long as the first positioning column 3 can pass through the second through hole 431. When the elastic member 5 is installed, it is only necessary to separate the second plate 43 from the first accommodating ring 42, place the elastic member 5 in the first accommodating ring 42, and cover the second plate 43 at the opening of the first accommodating ring 42**.

In order to facilitate quick positioning the position of the first cover body 4*a* relative to the second cover body 4*b* so as to achieve quick assembly, the second cover body 4*b* further includes a second accommodating ring 44 extending upwardly from a top surface of the second plate 43 and perpendicular to the top surface of the second plate 43, and one of the first accommodating ring 42 and the second accommodating ring 44 is sleeved on the other one of the first accommodating ring 42 and the second accommodating ring 44. In one example, the second accommodating ring 44 may be sleeved on the first accommodating ring 42 or the first accommodating ring 42 may be sleeved on the second accommodating ring 44.

In order to further improve the assembly efficiency of the first cover body 4*a* and the second cover body 4*b*, in this example, the first accommodating ring 42 and the second accommodating ring 44 are connected to each other through a buckle. In one example, an end portion of the first accommodating ring 42 is provided with a hook 45, the second accommodating ring 44 is provided with a slot 46, and the hook 45 can be snapped into the slot 46. In other examples, the hook 45 may be disposed on the second accommodating ring 44, and the slot 46 may be disposed on the first accommodating ring 42. The number of hooks 45 and slots 46 is not limited, and may be one, two or more. In this example, in order to improve the engagement stability, two hooks 45 and two slots 46 are adopted, and the two hooks 45 and the two slots 46 are arranged symmetrically about a central axis 402 of the pressing cover 4. In other examples, quick assembly may further be achieved in other ways, such as magnetic adsorption.

In one example, in order to limit the rotation of the saw blade 2 on a horizontal plane, an end surface of the pressing cover 4 abutting against the saw blade 2 may further be provided with a second positioning column 47 (referring to FIG. 5). The second positioning column 47 is used in combination with the second mounting hole 22 of the saw blade 2 (referring to FIG. 4), and the first positioning column 3 is used in combination with the first mounting hole 21 of the saw blade 2, so that the rotation of a free end of the saw blade 2 on the horizontal plane can be limited, and damage caused by collision with other saw blades 2 when the saw blade 2 rotates can be prevented. The number of second positioning columns 47 is not limited, as long as the number of second positioning columns 47 is not greater than the number of second mounting holes 22. In this example, the number of second positioning columns 47 is two, and the two second positioning columns 47 are arranged symmetrically with respect to the central axis 402 of the pressing cover 4 and are used in combination with the two second mounting holes 22 of the saw blade 2 respectively.

What is claimed is:

1. A tool box, comprising:

a box body forming an accommodation space for accommodating a tool head; and a tool-head fixing assembly configured to fix the tool head;

wherein the tool-head fixing assembly comprises a first positioning column and an elastic member, the first positioning column comprises a positioning part extending along a first straight line and a mounting part connected to the box body, the tool head is sleeved on the positioning part, the tool-head fixing assembly has an assembled state and a disassembled state, when the tool-head fixing assembly is in the assembled state, the elastic member is mounted above the tool head, the elastic member forms an interference fit with the positioning part, and a projection of the elastic member on a plane perpendicular to the first straight line at least partially coincides with a projection of the tool head on the plane perpendicular to the first straight line; and wherein the tool-head fixing assembly further comprises a pressing cover, the pressing cover is provided with a through hole, at least a part of the elastic member is located in the through hole, and, when the tool-head fixing assembly is in the assembled state, the pressing cover abuts against a top surface of the tool head.

2. The tool box of claim 1, wherein the pressing cover comprises a first cover body and a second cover body and the first cover body and the second cover body are detachably connected to each other.

3. The tool box of claim 2, wherein the first cover body comprises a first plate and a first accommodating ring extending from a surface of the first plate and in a direction perpendicular to the surface of the first plate, the first plate is provided with a first through hole communicating with an inner space of the first accommodating ring, the elastic member is disposed in the inner space of the first accommodating ring, the second cover body comprises a second plate, the second plate is configured to cover an opening end of the first accommodating ring, and the second plate is provided with a second through hole facing the first through hole.

4. The tool box of claim 3, wherein the second cover body further comprises a second accommodating ring extending from a surface of the second plate in a direction perpendicular to the surface of the second plate and one of the first accommodating ring and the second accommodating ring is sleeved on the other one of the first accommodating ring and the second accommodating ring.

5. The tool box of claim 4, wherein the first accommodating ring and the second accommodating ring are connected to each other through a buckle.

6. The tool box of claim 1, wherein the elastic member is a rubber ring.

7. The tool box of claim 1, wherein the tool head is provided with a mounting hole and an end surface of the pressing cover abutting against the tool head is provided with a second positioning column matched with the mounting hole.

8. The tool box of claim 7, wherein two second positioning columns are provided and the two second positioning columns are disposed symmetrically about a central axis of the pressing cover.

* * * * *